United States Patent [19]

Frigon et al.

[11] Patent Number: 4,516,115

[45] Date of Patent: May 7, 1985

[54] INTRUSION DETECTION SYSTEM

[75] Inventors: Raymond A. Frigon, Watertown; William G. Kahl, Jr., Brookfield, both of Conn.

[73] Assignee: Cerberus AG, Switzerland

[21] Appl. No.: 369,227

[22] Filed: Apr. 16, 1982

[51] Int. Cl.[3] ..... G08B 13/18

[52] U.S. Cl. ..... 340/556

[58] Field of Search ..... 340/552, 556, 557; 250/221

[56] References Cited

U.S. PATENT DOCUMENTS

| | | | |
|---|---|---|---|
| 3,235,738 | 2/1966 | Kress et al. | 250/221 |
| 3,390,388 | 6/1968 | Kahl, Jr. et al. | 340/556 |
| 3,653,021 | 3/1972 | Litman et al. | 340/556 |
| 3,743,290 | 7/1973 | Crimmins et al. | 250/221 |
| 3,752,978 | 8/1973 | Kahl, Jr. et al. | 340/556 X |

FOREIGN PATENT DOCUMENTS

| | | | |
|---|---|---|---|
| 2100 | 1/1978 | Japan | 340/556 |

*Primary Examiner*—James J. Gill

*Attorney, Agent, or Firm*—Brumbaugh, Graves, Donohue & Raymond

[57] ABSTRACT

The present invention provides an improved intrusion detection system of the type in which interruption of a beam of infrared energy transmitted from a transmitter to a receiver generates an alarm signal. The receiver includes a light source which remains unlighted when the transmitter and receiver are properly aligned but will be continuously lighted if either the beam is interrupted or the receiver and transmitter are not aligned. In one aspect of the invention, flasher circuitry in the receiver causes the light source to flash when the transmitted beam is only marginally aligned with the receiver. In another aspect of the invention, a lens in the receiver for focusing infrared radiation on a photodetector is movably mounted and accessible from the outside of the receiver to properly align the transmitted beam with the receiver without dismounting the receiver or requiring the use of any special alignment tools. A cylindrical lens in the transmitter provides a beam having a relatively narrow vertical component to further simplify alignment of the beam with the receiver by eliminating the problem of reflection of the transmitted beam by the ground surface. Accordingly, the improvement of the present invention provides an intrusion detection system in which the transmitted beam can be optimally aligned with the receiver without the use of any extraneous alignment equipment.

19 Claims, 13 Drawing Figures

INTRUSION DETECTION SYSTEM

BACKGROUND OF THE INVENTION

The present invention relates to intrusion detection systems and, more specifically, to intrusion detection systems in which interruption of a beam of invisible radiation, as, for example, infrared energy transmitted from a transmitter to a receiver, generates an alarm signal.

In intrusion systems of the above type, the transmitter and receiver are generally mounted to opposed walls near the area to be protected so that a transmitted beam of radiation scans the protected area, which may be, for example, near the inside of the front door or windows of a premises. Intruders entering the protected area break the transmitted beam of invisible radiation. Photodetection circuitry within the receiver, responsive to the absence of the transmitted beam, actuates alarm circuitry.

Optimum alignment of the transmitted beam of radiation and the receiver is of critical importance in the above described type of intrusion detection system. The receiver generates an alarm signal in response to non-detection of the transmitted beam, but cannot discriminate between absence of the beam due to interruption by an intruder or due to non-alignment of the beam and the receiver. Accordingly, improper alignment of the receiver and the transmitted beam can result in false intrusion alarm signals.

Various procedures for aligning the receiver and the transmitted beam are currently used. For example, the receiver may be pivotally mounted to its supporting surface and pivoted until a basic alignment is achieved. Alignment lights may be used for this purpose. After the basic alignment is established, a cutoff tool must be used to determine if the alignment is optimum or marginal. The cutoff tool blocks a certain percentage of the beam receiving surface of the receiver, usually of the order of 75%, for preventing the receiver from detecting a portion of the transmitted energy directed towards it. An alarm signal generated by this partial obstruction indicates that the transmitted beam and receiver are not optimally aligned, and the alignment procedure must then be repeated and further refined. It is apparent that the above described alignment procedure is complicated, time consuming, and requires tools and equipment in addition to the operating components of the system itself.

It is an object of the present invention to provide an intrusion detection system of the above discussed type in which simplified means for aligning the transmitted beam with the receiver, and means for indicating when such alignment is marginal, are incorporated directly into the receiver, enabling alignment to be made without the use of any special alignment tools. It is a further object of the invention to provide an intrusion detection system in which the transmitted beam has a relatively narrow vertical component to prevent reflection of the beam off the ground surface to further facilitate alignment of the beam and the receiver.

SUMMARY OF THE INVENTION

An intrusion detection system includes a transmitter and a receiver for receiving invisible wavelengths of radiation, such as infrared, transmitted from the transmitter. Electronic detection circuitry within the receiver actuates both an alarm and a lamp in the receiver when the transmitted beam is not detected by the receiver. A movable lens within the receiver for focusing the transmitted beam on the detection circuitry is adjusted until the lamp in the receiver goes out, indicating proper alignment of the beam. Flasher circuitry within the receiver causes the lamp to flash when only marginal alignment has been achieved. A lens in the transmitter provides the transmitted beam with a relatively narrow vertical component to prevent the beam from being reflected off the ground surface to facilitate alignment of the beam with the receiver. Accordingly, the intrusion detection system of the present invention provides optimal alignment of the transmitted beam and the receiver in a quick and simple manner not requiring the use of any extraneous alignment tools.

DESCRIPTION OF THE PREFERRED EMBODIMENTS

Figure 1:
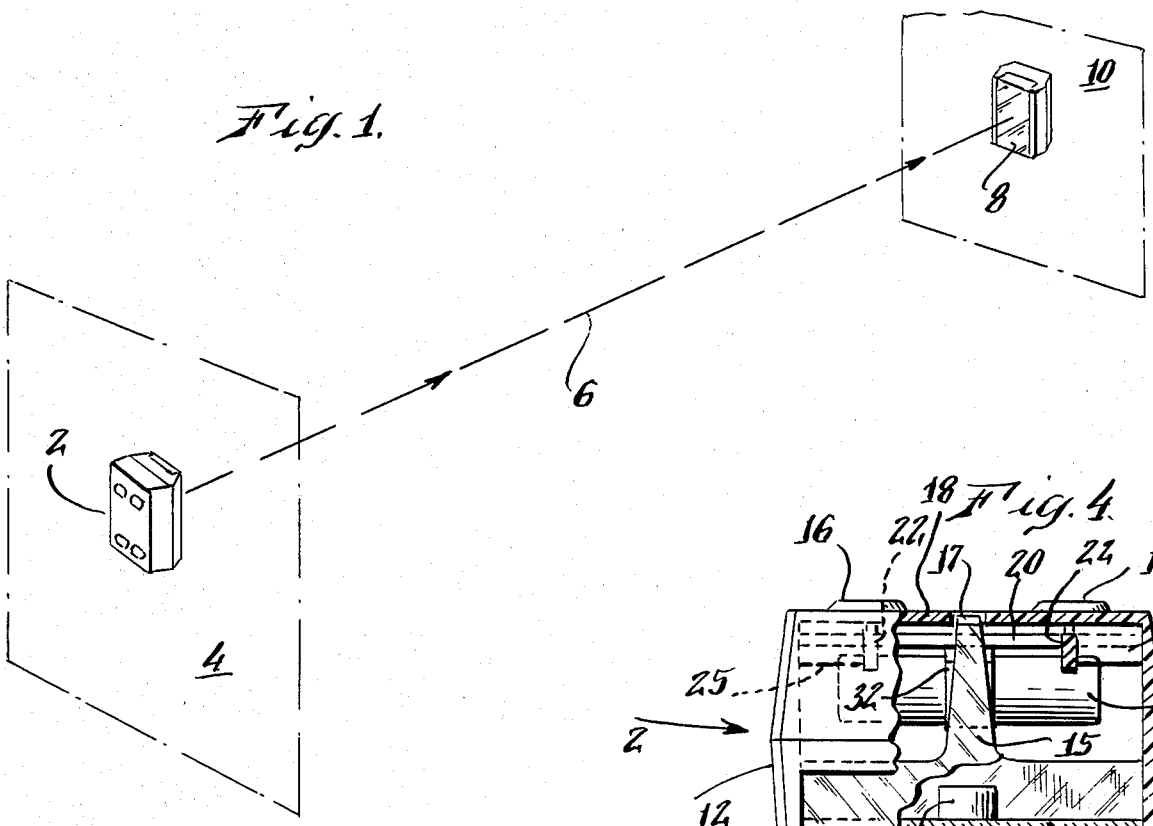
FIG. 1 is a perspective view of an intrusion detection system in accordance with the present invention in which a beam of invisible radiation is transmitted between a transmitter and a receiver.
Figure 4:
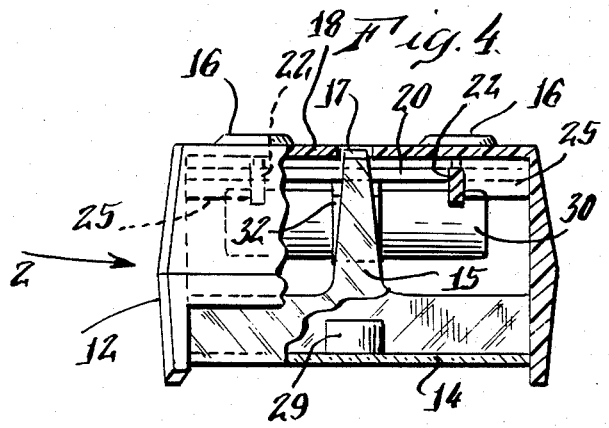
FIG. 4 is a sectional view of the transmitter as seen along line 4—4 of FIG. 2.
Figure 5:
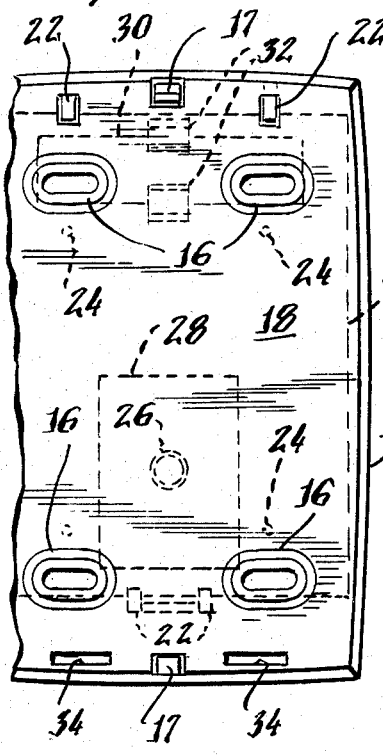
FIG. 5 is a rear elevational view of the transmitter.

FIG. 1 schematically illustrates the overall intrusion detection system of the present invention in its operative state. A transmitter 2 mounted to a supporting surface such as a wall 4, transmits a beam of radiation 6 to a receiver 8 mounted to an opposed supporting surface, such as a wall 10. The transmitter and receiver are in alignment so that the transmitted radiation 6 strikes the central portion of the receiver. The beam of transmitted radiation has a wavelength outside that of visible light, preferably being in the infrared range, so that the beam 6 spanning the area between the transmitter and receiver is not visible to the human eye. The receiver includes detection means, generally known to the art, which provide an alarm signal when the beam 6 is interrupted, as for example, by an intruder passing between the transmitter and receiver. The receiver itself is coupled to conventional alarm means (not shown) so that the alarm signal generated by the receiver actuates an alarm.

FIGS. 2–5 illustrate the transmitter 2 used in the intrusion detection system shown in FIG. 1. The transmitter includes a generally rectangular shaped housing 12 having a cover 14 removably secured to the front of the housing. Preferably, the housing and cover are formed from light weight plastic. Specifically, the cover 14 includes upper and lower inwardly directed prongs 15 which are removably received in corresponding openings 17 in the rear of the housing 12. Four openings 16 are provided on the rear wall 18 of the transmitter housing 12 for mounting it to the supporting surface or wall 4. A circuit board 20, which carries all of the electronic components of the transmitter, is removably secured to the inside surface of the rear wall of the transmitter housing by clips 22. A plurality of spacers 24 separate the back of the circuit board from the rear wall of the transmitter housing when the circuit board is clipped into its operational position as illustrated. Two resilient pads 25 mounted to the top corners of the housing adjacent to the upper clips 22 separate the top of the circuit board from the top of the housing. The removable circuit board provides for easy maintenance and replacement of the electronic components of the transmitter.

Figure 3:
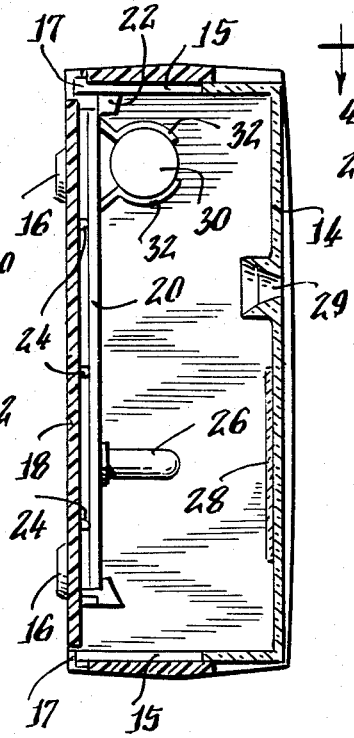
FIG. 3 is a sectional view of the transmitter as seen along line 3—3 of FIG. 2.
Figure 2:
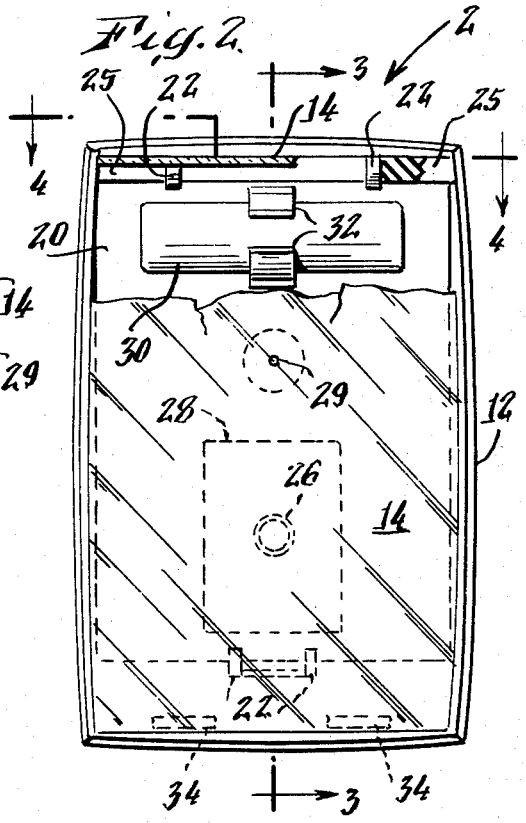
FIG. 2 is a front elevational view, partially in section, of a transmitter used in the intrusion detection system illustrated in FIG. 1.

A source of invisible radiation, such as an infrared bulb 26, is mounted to the transmitter circuit board 20 and extends towards the front of the transmitter 2. A cylindrical Fresnel lens 28 is affixed to the inside of the transmitter front cover 14 such that the lens is aligned with the bulb 26 when the cover is mounted on the transmitter as illustrated in FIG. 3. As will be discussed in greater detail below, the transmitter lens 28 provides a transmitted beam of radiation 6 having a relatively wide horizontal component and a relatively narrow vertical component for eliminating reflection of the transmitted beam from the ground surface or floor of the protected zone between the transmitter and receiver. A window or opening 29 is provided on the transmitter cover 14 above the lens 28.

A battery 30 is mounted to the transmitter circuit board 20 by a battery clip 32. The battery can be used as an alternate secondary back up source when the primary source is line voltage. Openings 34 are provided in the transmitter housing for receiving wires connecting the transmitter circuit board to the line voltage. Use of a battery as a back up source in the event of a power failure is conventional and known to the art.

Figure 8:
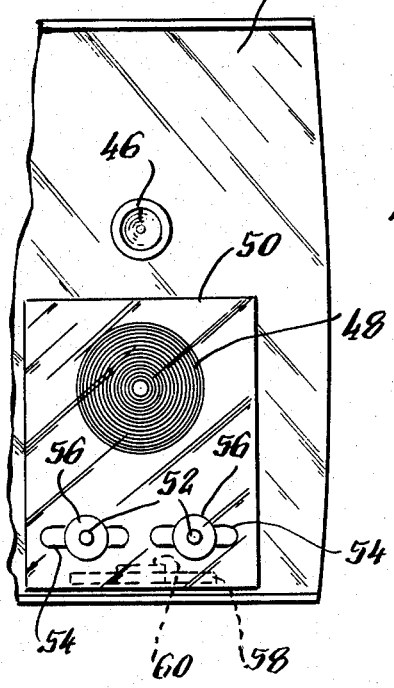
FIG. 8 is a partial front elevational view of the inside of the front cover of the receiver shown in FIGS. 6 and 7.
Figure 7:
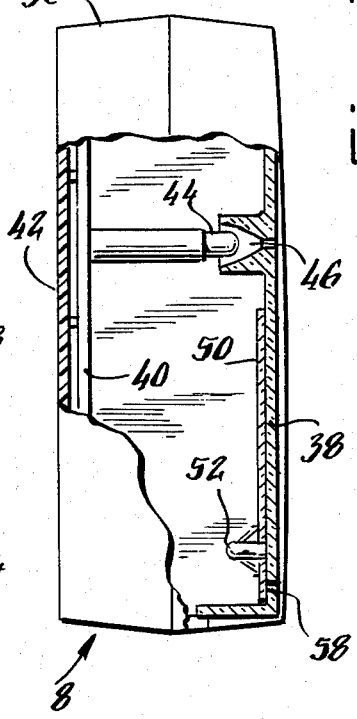
FIG. 7 is a sectional view of the receiver seen along line 7—7 of FIG. 6.
Figure 6:
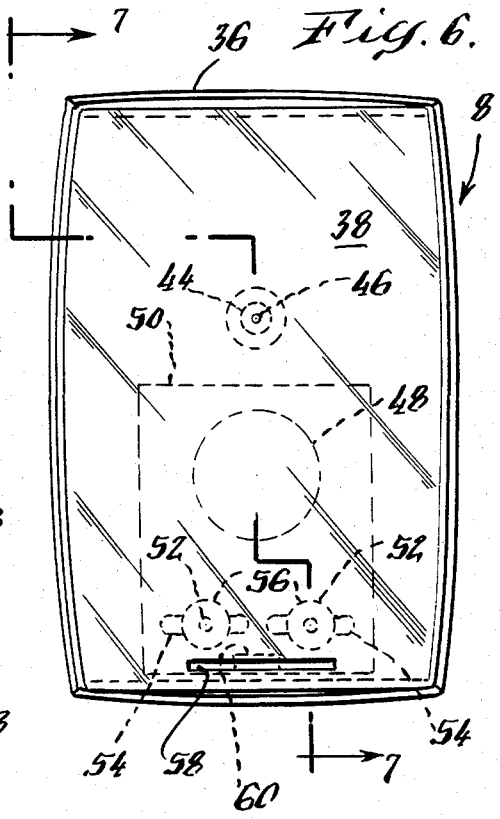
FIG. 6 is a front elevational view of a receiver used in the intrusion detection system illustrated in FIG. 1.

The receiver 8, shown schematically in FIG. 1, is illustrated in greater detail by FIGS. 6–8. It includes a generally rectangular receiver housing 36 and a front cover 38 adapted to be removably mounted to the front of the housing. A receiver circuit board 40 is removably mounted to the inside surface of the rear wall 42 of the receiver housing. The physical construction of the housing 36 and its front cover 38, the means provided for mounting the housing to a supporting surface (e.g., the wall 10 of FIG. 1), the means for mounting the circuit board 40 inside the housing, and the means for mounting the cover 38 to the front of the housing, are identical to that already described with reference to the transmitter and will not be repeated herein.

A light source 44, preferably a light emitting diode, is mounted to the receiver circuit board and extends towards the front cover 38. This LED, which emits visible light rays, is used for alignment and will be discussed in greater detail below. An opening 46 is provided on the receiver front cover 38 so that the LED is aligned with that opening when the cover is mounted to the receiver housing in its operational state as shown in FIG. 7. This arrangement enables the LED 44 to be observed from outside the receiver even when the cover 38 is mounted to the front of the receiver housing. Note that the opening 29 on the transmitter cover 14 (FIG. 3) is identical to the opening 46 on the receiver cover. Although opening 29 serves no functional purpose in the transmitter, the same cover may be used on both transmitter and receiver for reasons of economy.

A circular Fresnel lens 48 is formed on a transparent plate or panel 50 which is movably mounted to the inner surface of the receiver front cover 38. More specifically, two projections or members 52 extend inwardly from the inner surface of the cover 38 and are received through two corresponding oval openings or slots 54 defined towards the bottom of the transparent panel 50. Each member 52 has a relatively wide head portion 56 which is wider than the width of the oval openings 54 for preventing the panel 50 from detaching from the inside of the receiver cover. However, the heads 56 are mounted to the members 52 to provide sufficient clearance to permit the panel 50 to slide laterally throughout the entire length of the openings 54 with the members 52 acting as stops for the panel. Accordingly, the panel 50 can be slid right, as viewed in FIG. 8, until the left ends of the openings abut against the members 52, and the panel 50 can be slid left until the right ends of the openings abut against the members 52. This movable mounting arrangement enables the position of the panel 50 and its lens 48 to be adjusted relative to the circuit board 40 within the receiver housing.

A slot 58 in the lower surface of cover 38 and a corresponding inwardly directed recessed portion or opening 60 defined in the panel 50 and aligned with the slot 58 enable the panel to be slid from the outside of the cover. More specifically, a tool, such as a screwdriver, is inserted through the slot 58 and into the recess or opening 60 in the panel. A lateral force applied to the inserted member slides the panel, and thus also the lens, along the slot in the receiver cover.

Figure 10:
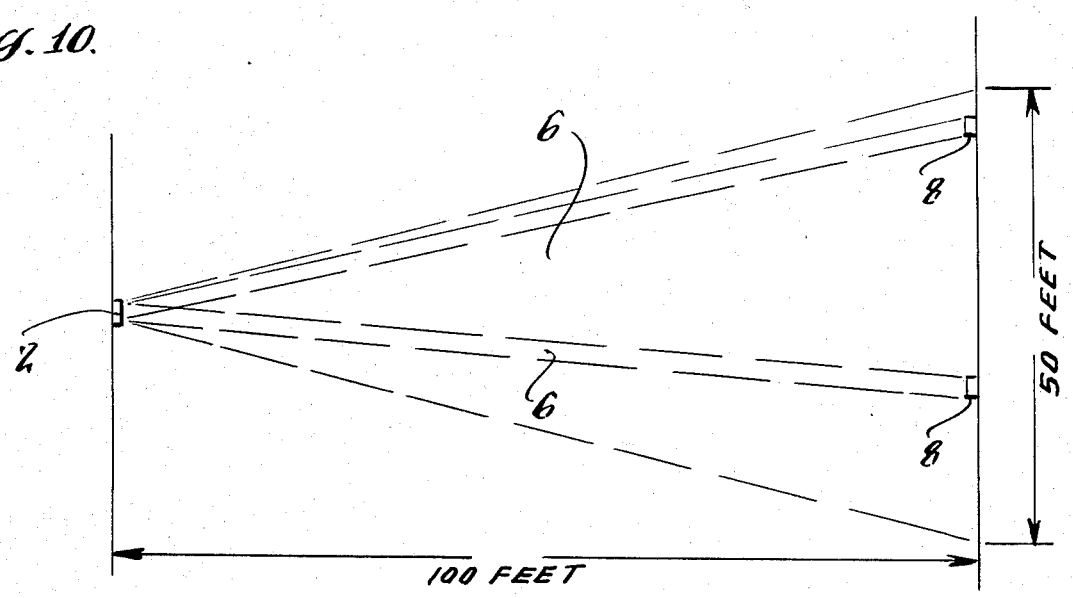
FIG. 10 is a diagramatic top plan view of an intrusion detection system including a single transmitter and two receivers.
Figure 11:
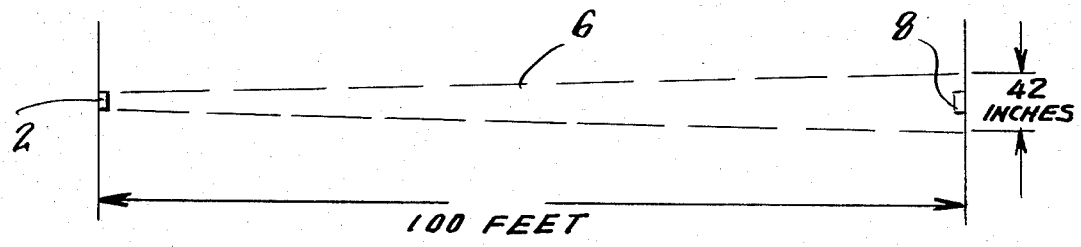
FIG. 11 is a side elevational view of the system shown in FIG. 10.
Figure 13:
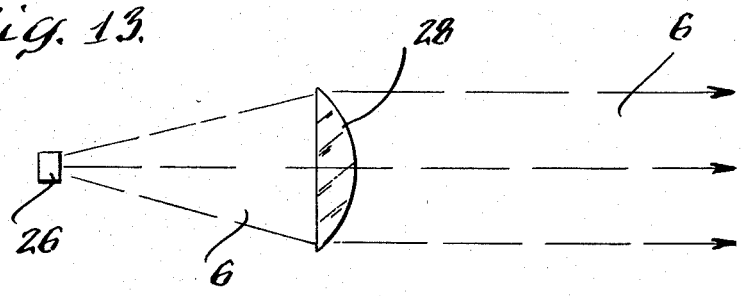
FIG. 13 is a side view of the cylindrical lens of FIG. 12 collimating radiation from the transmitter in a vertical plane.
Figure 12:
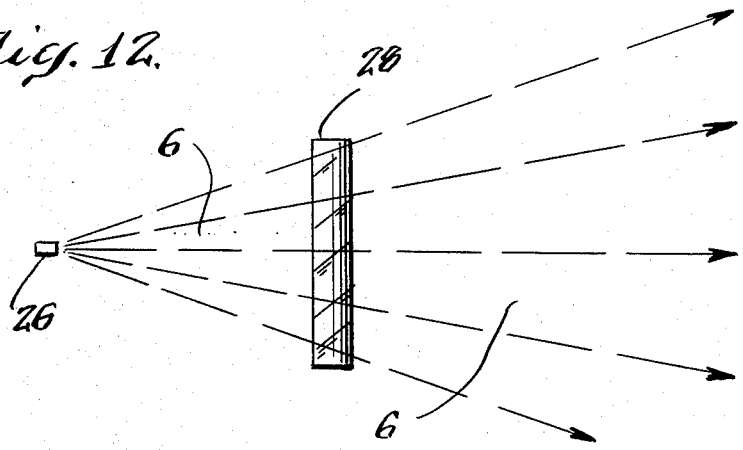
FIG. 12 is a top view of a cylindrical lens dispersing radiation from the transmitter in a horizontal plane.

FIGS. 10–13 schematically illustrate the optical features of the present intrusion detection system. As noted above, the cylindrical lens 28 mounted to the inside cover of the transmitter 2 is selected to provide a transmitted beam 6 having a relatively wide horizontal component and a relatively narrow vertical component. As illustrated by FIGS. 10 and 12, the horizontal component of beam 6 from transmitter 2 can be of sufficient width to control two or more receivers 8. In this manner, a single transmitter advantageously provides two or more separate protected zones. More specifically, at a distance of 100 feet between the transmitter and receiver (or receivers), the lens 28 provides a beam that is approximately 50 feet wide (28° horizontal). However, the vertical component of the beam at the 100 feet range is preferably not greater than 42 inches (2° vertical), as illustrated by FIGS. 11 and 13.

Providing a transmitted beam with a narrow vertical component helps eliminate the problem of false alarm signals or misalignment of the transmitted beam and the receiver caused by reflection of the transmitted beam off the ground surface between the transmitter and receiver. The vertical component is sufficiently narrow so that the transmitter can be mounted at a predetermined elevation (generally slightly above one-half of the maximum vertical component for the desired range) and the transmitted beam will not strike the ground surface.

Intrusion detection systems generally of the above described type include detection means, as for example, a photodiode and a comparator in the receiver. (If the transmitted radiation is infrared, any other conventional infrared detectors may be used.) In the event that less than a predetermined threshold level of radiation is detected at the receiver, an alarm signal is generated, Thus, either interruption of the beam by an intruder when the system is in operation, or misalignment of the transmitted beam and the receiver when placing the system into operation, will result in an alarm signal at the receiver. The threshold level of detected radiation at the receiver which will result in an alarm signal is set close to the level at which no radiation is detected at the receiver. Preferably, the alarm signal will be generated when the energy detected at the receiver is less than 10% of the maximum energy or intensity of the transmitted beam. In any event, the use and operation of photodetectors and comparators in active intrusion alarm systems is known to the art.

As noted in the background discussion herein, obtaining proper alignment of the transmitted beam and the receiver in an active intrusion detection system can be difficult and time consuming. Moreover, once a basic alignment is achieved, additional tools and steps are required to determine whether the alignment is marginal and thus requires further refinement. These problems are overcome by the above described intrusion detection system, the operation of which will now be described with reference primarily to FIGS. 6–9.

Figure 9:
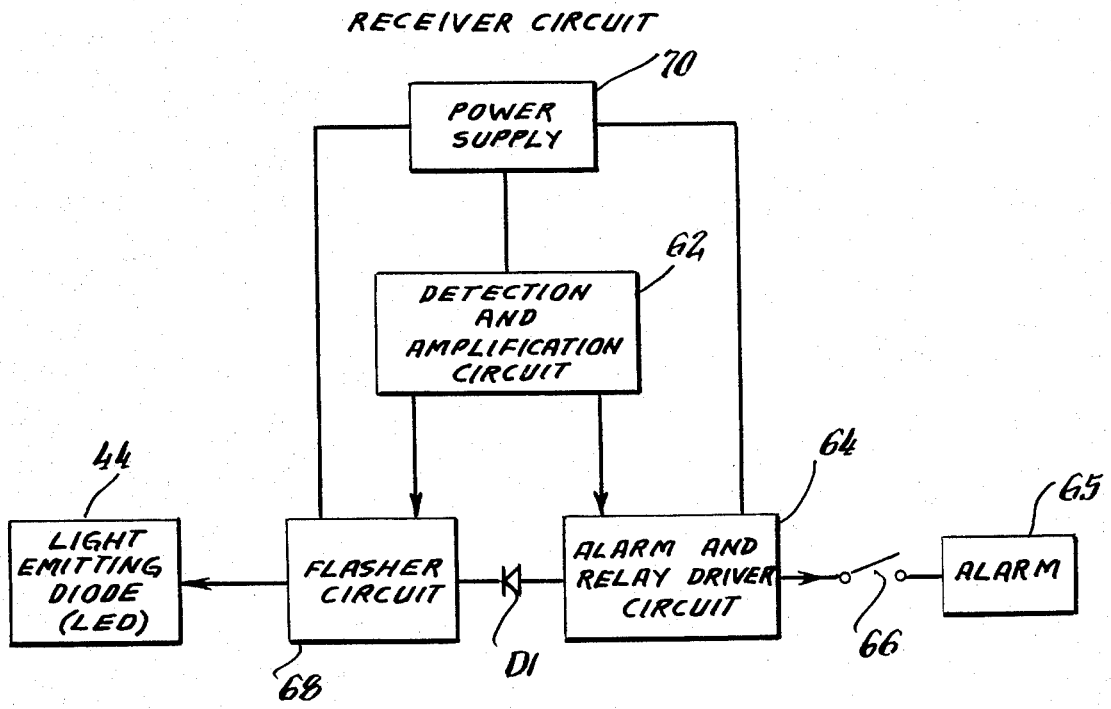
FIG. 9 is a block circuit diagram illustrating the electronic circuitry of the receiver.

FIG. 9 illustrates the electronic components of the receiver 8 in block diagrams format. In setting up the intrusion detection system, the transmitter 2 and the receiver 8 initially are mounted on opposed walls in substantial alignment with each other, as generally shown in FIG. 1. Preferably, the front covers of both the receiver and transmitter are opaque to visible light to conceal these units from the view of an intruder. The circular Fresnel lens 48, movably mounted to the inside front cover of the receiver 8 (FIG. 8), focuses transmitted radiation striking the receiver onto a detection and amplification circuit 62 in the receiver. This circuit includes a conventional detector as, for example, a photodiode for converting the detecting radiation into an electrical signal, and conventional amplifiers for amplifying the magnitude of the resultant electrical signal corresponding to the detected radiation.

The output of the detection and amplification circuit is coupled to both an alarm and relay driver circuit 64 and a flasher circuit 68, and a power supply 70 is coupled to the amplification and detection circuitry, the alarm driver circuit, and the flasher circuit. The alarm and relay driver circuit 64 is conventional and includes a comparator and an alarm relay driven by the comparator. The comparator is set at an alarm threshold level so that when the electrical signal to the alarm circuit 64 from the detection and amplification circuit 62 is below the alarm threshold level for more than a predetermined time period (generally on the order of 75 milliseconds), the alarm relay is deenergized and an alarm signal is generated. The alarm threshold level is preferably set to correspond to the electrical signal to the alarm and relay driver circuit from the detection and amplification circuit when less tha 10%–15% of the maximum energy or intensity of the transmitted beam (e.g., maximum amplitude at the center of the transmitted beam at the maximum range of transmission is detected at the receiver for the maximum range of transmission (i.e., maximum operating distance between the transmitter and receiver).

Accordingly, an alarm signal is generated by the alarm circuit 64 when either no transmitted beam is detected at the receiver or less than 10%–15% of the peak energy of the transmitted beam is detected. The alarm signal is supplied to conventional alarm means 65 through a switch 66. It is also supplied to the light emitting diode 44 in the receiver (FIG. 7) through a flasher circuit 68 (to be discussed below) causing that diode to remain continuously lighted and emitting visible light during an alarm condition.

When setting up the detection system for operation, switch 66 is opened to prevent actuation of the alarm 65. Then, the light emitting diode is observed through the opening 46 in the receiver housing cover. If the diode is lighted, the detection circuit is receiving less than the required threshold level of transmitted radiation, indicating that the transmitted beam and receiver are not properly aligned.

If such misalignment exists, the panel 50 carrying the circular lens 48 on the receiver cover 38 (FIGS. 6 and 8) is slid laterally to focus a greater portion of the transmitted beam on the detection circuit in the receiver until the light emitting diode is extinguished. When this occurs, the detection circuit is aligned with the transmitted beam and the system is operational. Switch 66 is then closed so that any subsequent interruption of the transmitted beam at the receiver will actuate the alarm 65.

As discussed above, once a basic alignment is achieved in the known intrusion detection systems, extraneous alignment tools, such as a mask, must be placed over the receiver to determine if the alignment is only marginal and therefore must be refined further. Specifically, a mask is positioned to block approximately 75% of the receiving surface area of the receiver. Generation of an alarm signal indicates that the system is only marginally aligned. It will now be shown how the present system eliminates the use of the separate alignment tools now required to perfect the alignment.

Referring back to FIG. 9, a flasher circuit 68 in the receiver automatically indicates when the alignment of the beam and the receiver is only marginal. The flasher circuit, which includes conventional oscillator circuitry, is coupled at its input end to the output of detection circuit 62 and at its output end to the light emitting diode 44 in the receiver. In the event that the output electrical current signal from the detection and amplification circuit 62 exceeds the alarm threshold level of the comparator in the alarm circuit 64 (and thus no alarm signal is generated), but is less than a second predetermined threshold level, the flasher circuit is actuated and causes the light emitting diode 44 to flash. The flasher circuit 68 includes a comparator set at the second threshold level and coupled to the electrical signal from the detection circuit 62. This second threshold level is set to correspond to the electrical signal received by the comparator in the flasher circuit from the detection circuit 62 when the beam of transmitted radiation received by the detection circuit is less than 75% of the peak energy or intensity (e.g., maximum amplitude) of the transmitted beam of the transmitter at the maximum range of transmission (i.e., maximum operating distance between the transmitter and receiver).

Thus, when less than 75% of the maximum energy of the transmitted beam is detected at the detection circuit, the comparator in the flasher circuit actuates conventional oscillator circuitry and causes the light emitting diode 44 to flash visible light. The flashing diode indicates that less than 75% of the energy of the transmitted beam is being detected at the receiver, and the alignment of the transmitter and receiver is only marginal and requires further refinement. The movable lens 48 on the receiver must be adjusted until the light emitting diode is totally extinguished, thereby indicating that the receiver is detecting more than 75% of the transmitted beam and the alignment is optimum.

By the foregoing alignment technique the installer can be assured that the level of energy at the detector is sufficient to meet the standard test technique whereby there is above threshold energy when approxmately 75% of the receiving surface area of the receiver is blocked. Since the second threshold level (75%) is more than four times the first threshold level (10 to 15%), alignment which is sufficient to stop the flashing of the light source at the receiver will be more than sufficient to meet the standard test.

As shown in FIG. 9, the alarm signal from the alarm circuit 64 causing the light emitting diode to remain continuously lighted is coupled to the light emitting diode through the flasher circuit 68. Accordingly, control means are provided to override the flasher circuitry so that the light emitting diode remains continuously lighted when an alarm signal is generated by the alarm circuit. More specifically, the output of the comparator in the alarm circuitry is coupled to the output of the comparator in the flasher circuitry by a diode D1 which conducts only in the direction from the alarm circuit to the flasher circuit. When an alarm signal is generated, the signal from the output of the alarm comparator overrides the flasher comparator output signal and its associated oscillator circuitry to cause the light emitting diode to remain lighted continuously.

In summary, the intrusion detection system disclosed herein provides means for readily aligning the transmitted beam with the receiver simply by sliding a movable receiver lens until an alignment lamp first flashes and then is totally extinguished. The system automatically indicates when the alignment is only marginal and requires further refinement without using external alignment tools. The transmitter provides a transmitted beam having a narrow vertical component to eliminate reflection of the beam from the ground to further facilitate the optimal alignment of the beam and the receiver.

The above discussion of the intrusion detection system is intended to be illustrative only and not restrictive of the scope of the invention, that scope being defined by the following claims and all equivalents thereof.

What is claimed is:

1. In an intrusion detector system of the type including a transmitter for transmitting a beam of electromagnetic energy, and a receiver including means for detecting said transmitted energy and means, including a first threshold detector, responsive to said detected energy for generating an alarm signal when the level of said detected energy does not exceed a first threshold value, the improvement comprising:

a light source mounted in said receiver and coupled to said alarm signal generating means such that said source is continuously lighted when said generating means generates an alarm signal, and flasher circuitry mounted within said receiver and interposed between said means for detecting and said light source and including a second threshold detector responsive to said detected energy for flashing said source when said detected energy does not exceed a second threshold value at least four times greater than said first threshold value.

2. The system as claimed in claim 1 further including a first lens mounted to said receiver for focusing said beam of energy transmitted on said means for detecting in said receiver, and means for adjusting the position of said first lens relative to said means for detecting.

3. The system as claimed in claim 2 wherein said means for adjusting the position of said first lens is accessible from the outside of said receiver.

4. The system as claimed in claim 3 wherein said first lens is a Fresnel lens.

5. The system as claimed in claim 2 wherein said receiver includes a front cover and said first lens is movably mounted to said front cover for adjusting the position of said first lens relative to said means for detecting.

6. The system as claimed in claim 1 wherein said source is a light emitting diode.

7. The system as claimed in claim 1 further including a second lens mounted to said transmitter for providing said transmitted beam of energy with a narrow vertical component relative to its horizontal component.

8. The system as claimed in claim 7 wherein said transmitter includes a front cover and said second lens is mounted to said front cover.

9. The system as claimed in claim 7 wherein said second lens is a cylindrical lens.

10. The system as claimed in claim 7 wherein said vertical component of said transmitted beam at said receiver is effectively no greater than 42" when the distance between said transmitter and receiver is 100'.

11. The system as claimed in claim 1 wherein said first threshold value of detected energy is in the range of 0 to 15% of the maximum energy of the transmitted beam at the maximum range.

12. The system as claimed in claim 1 wherein said second threshold value of detected energy is not less than 75% of the maximum energy of the transmitted beam at the maximum range.

13. In an intrusion detection system of the type including a transmitter for transmitting a beam of electromagnetic energy, and a receiver including means for detecting said transmitted energy and means responsive to said detected energy for generating an alarm signal when the level of said detected energy does not exceed a first threshold value, the improvement comprising:

means at said transmitter for forming said transmitted beam with a relatively wide horizontal beamwidth and a relatively narrow vertical beamwidth, thereby to define a region in which said receiver may be located, said region being vertically larger than said receiver and horizontally much larger than said receiver at normal receiver range; and a first lens mounted to said receiver for focusing at least a portion of said beam of energy striking said receiver onto said detecting means within said receiver said lens being arranged for horizontal movement with respect to said detecting means so that, when said receiver is mounted in said region, said first lens can be located to focus said beam on said detecting means by moving only said first lens.

14. The system as specified in claim 13 wherein said means for forming said transmitted beam comprises a source of electromagnetic energy and a cylindrical lens for focusing said energy into said narrow vertical beamwidth.

15. The system as specified in claim 13 wherein said receiver further includes a light source coupled to said alarm signal generating means whereby said light source is continuously lighted when said detected energy does not exceed said first threshold value and a flasher circuit connected to said detector means and said light source for flashing said light source when said detected energy does not exceed a second, higher threshold value.

16. The system as claimed in claim 13 wherein said receiver includes a receiver housing and a front cover removably mounted to said housing, said first lens being movably mounted to said front cover.

17. The system as claimed in claim 16 wherein said first lens is mounted to the inside of said front cover on a movable panel, said front cover including a slot defined therein, said movable panel having a recess or opening defined therein in alignment with said slot on said front cover, said panel being slidable along said slot in said front cover, whereby said first lens is movable from outside of said front cover by insertion of a member through said slot in said front cover and into said recess or opening in said panel for sliding said panel along said slot in said front cover.

18. A photoelectric intrusion detection system, comprising:

a transmitter for transmitting a beam of optical energy, including a light source and a cylindrical lens for focusing light from said source into a transmitted beam having a relatively narrow vertical beamwidth and a relatively wide horizontal beamwidth, thereby to define a region in which said beam may be detected, and at least one receiver, located in said region for receiving said optical energy, said receiver including an optical detector and a lens for focusing said energy onto said optical detector, said lens being vertically smaller than said region and horizontally much smaller than said region and being mounted for horizontal motion with respect to said detector, thereby to focus said beam onto said detector when said receiver is in said region, and said receiver including an alarm circuit responsive to the output of said detector for generating an alarm signal when said detector receives less than a first threshold level of detected energy and a light source coupled to said alarm circuit and arranged to be continuously illuminated by said alarm signal, and said receiver including a flasher circuit connected to said detector and said light source for flashing said light source when said detected energy does not exceed a second, higher threshold value.

19. The system of claim 18 further including a plurality of receivers spaced apart from each other, said horizontal component of said transmitted beam being sufficiently wide to control said plurality of receivers so that a plurality of protected zones can be provided by one transmitter and said plurality of receivers.

* * * * *